US010950367B1

(12) United States Patent
Baechtle

(10) Patent No.: US 10,950,367 B1
(45) Date of Patent: Mar. 16, 2021

(54) ELECTRICAL CABLE

(71) Applicant: TE CONNECTIVITY CORPORATION, Berwyn, PA (US)

(72) Inventor: David Robert Baechtle, Dillsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/561,884

(22) Filed: Sep. 5, 2019

(51) Int. Cl.
*H01B 11/06* (2006.01)
*H01B 11/20* (2006.01)

(52) U.S. Cl.
CPC ..... *H01B 11/06* (2013.01); *H01B 11/20* (2013.01)

(58) Field of Classification Search
CPC ..... H01B 11/04; H01B 11/06
See application file for complete search history.

(56) References Cited

U.S. PATENT DOCUMENTS

| | | | | |
|---|---|---|---|---|
| 3,340,353 | A | 9/1967 | Mildner | |
| 3,439,111 | A | 4/1969 | Miracle et al. | |
| 4,221,926 | A | 9/1980 | Schneider | |
| 4,439,632 | A * | 3/1984 | Aloisio, Jr. | H01B 7/18 174/106 D |
| 4,596,897 | A | 6/1986 | Gruhn | |
| 4,644,092 | A | 2/1987 | Gentry | |
| 4,863,576 | A | 9/1989 | Collins et al. | |
| 5,142,100 | A | 8/1992 | Vaupotic | |
| 5,329,064 | A | 7/1994 | Tash et al. | |
| 5,349,133 | A | 9/1994 | Rogers | |
| 5,574,815 | A | 11/1996 | Kneeland | |
| 5,619,016 | A | 4/1997 | Newmoyer | |
| 6,010,788 | A | 1/2000 | Kebabjian et al. | |
| 6,403,887 | B1 | 6/2002 | Kebabjian et al. | |
| 6,504,379 | B1 | 1/2003 | Jackson | |
| 6,677,518 | B2 | 1/2004 | Hirakawa et al. | |
| 6,731,849 | B1 | 5/2004 | Singh et al. | |
| 7,314,998 | B2 | 1/2008 | Amato et al. | |
| 7,790,981 | B2 | 9/2010 | Vaupotic et al. | |

(Continued)

FOREIGN PATENT DOCUMENTS

| | | | |
|---|---|---|---|
| CN | 201327733 | Y | 10/2009 |
| CN | 201359878 | Y | 12/2009 |

(Continued)

OTHER PUBLICATIONS

IVG Fiber "Single-Mode Fibers" (1 page).

(Continued)

*Primary Examiner* — Chau N Nguyen

(57) ABSTRACT

An electrical cable includes a conductor assembly having conductors and an insulator. The electrical cable includes a cable shield wrapped around the conductor assembly having an inner edge at a first end segment and an outer edge at a second end segment. The second end segment is wrapped over the inner edge and the first end segment to form a flap covering the inner edge and the first end segment. The second end segment forms a void at the inner edge. The electrical cable includes a void shield on the outer surface between the insulator and the cable shield. The void shield extends between a first end and a second end. The void shield is aligned with the void and spans entirely across the void. The cable shield is electrically connected to the void shield.

20 Claims, 3 Drawing Sheets

(56) References Cited

U.S. PATENT DOCUMENTS

| | | | |
|---|---|---|---|
| 7,827,678 | B2 | 11/2010 | Dion et al. |
| 7,999,185 | B2 | 8/2011 | Cases et al. |
| 8,378,217 | B2 | 2/2013 | Sugiyama et al. |
| 8,381,397 | B2 | 2/2013 | Dion et al. |
| 8,440,910 | B2 | 5/2013 | Nonen et al. |
| 8,459,691 | B2 | 10/2013 | Watanabe et al. |
| 8,552,291 | B2 | 10/2013 | Lingambudi et al. |
| 8,575,488 | B2 | 11/2013 | Sugiyama et al. |
| 8,674,228 | B2 | 3/2014 | Dion et al. |
| 8,866,010 | B2 | 10/2014 | Nonen et al. |
| 8,981,216 | B2 | 3/2015 | Grant et al. |
| 8,993,883 | B2 | 3/2015 | Kumakura et al. |
| 9,064,621 | B2 | 6/2015 | Kodama et al. |
| 9,117,572 | B2 | 8/2015 | Fukasaku |
| 9,123,452 | B2 | 9/2015 | Sugiyama et al. |
| 9,123,457 | B2 | 9/2015 | Kaga et al. |
| 9,136,042 | B2 | 9/2015 | Sugiyama et al. |
| 9,142,333 | B2 | 9/2015 | Kaga et al. |
| 9,159,472 | B2 | 10/2015 | Nordin et al. |
| 9,214,260 | B2 | 12/2015 | Ishikawa et al. |
| 9,299,481 | B2 | 3/2016 | Ishikawa et al. |
| 9,349,508 | B2 | 5/2016 | Nonen et al. |
| 9,350,571 | B2 | 5/2016 | Watanabe et al. |
| 9,466,408 | B2 | 10/2016 | Sugiyama |
| 9,484,127 | B2 | 11/2016 | Sugiyama et al. |
| 9,496,071 | B2 | 11/2016 | Nagahashi |
| 9,548,143 | B2 | 1/2017 | Sugiyama et al. |
| 9,583,235 | B2 | 2/2017 | Nonen et al. |
| 9,660,318 | B2 | 5/2017 | Sugiyama et al. |
| 10,283,238 | B1 | 5/2019 | Shanbhaag et al. |
| 10,283,240 | B1 | 5/2019 | Shanbhag et al. |
| 10,304,592 | B1 | 5/2019 | Hornung et al. |
| 2003/0150633 | A1 | 8/2003 | Hirakawa et al. |
| 2006/0254801 | A1 | 11/2006 | Stevens |
| 2009/0074959 | A1 | 3/2009 | Sezerman et al. |
| 2010/0307790 | A1 | 12/2010 | Okano |
| 2011/0083877 | A1 | 4/2011 | Sugiyama et al. |
| 2011/0100682 | A1 | 5/2011 | Nonen et al. |
| 2011/0127062 | A1 | 6/2011 | Cases et al. |
| 2012/0024566 | A1 | 2/2012 | Shimosawa et al. |
| 2012/0080211 | A1 | 4/2012 | Brown et al. |
| 2012/0152589 | A1 | 6/2012 | Kumakura et al. |
| 2012/0227998 | A1 | 9/2012 | Lindstrom et al. |
| 2013/0175081 | A1 | 7/2013 | Watanabe et al. |
| 2013/0333913 | A1 | 12/2013 | Nonen et al. |
| 2014/0048302 | A1 | 2/2014 | Nonen et al. |
| 2014/0102783 | A1 | 4/2014 | Nagahashi |
| 2014/0305676 | A1 | 10/2014 | Sugiyama et al. |
| 2015/0000954 | A1 | 1/2015 | Nonen et al. |
| 2015/0235742 | A1 | 8/2015 | Fu et al. |
| 2015/0255592 | A1 | 9/2015 | Liptak et al. |
| 2016/0111187 | A1 | 4/2016 | Kodama |
| 2016/0155540 | A1 | 6/2016 | Matsuda et al. |
| 2016/0268021 | A1* | 9/2016 | Koeppendoerfer ..... H01B 13/2693 |
| 2016/0300642 | A1 | 10/2016 | Kodama et al. |
| 2016/0343474 | A1 | 11/2016 | Nichols |
| 2016/0372235 | A1 | 12/2016 | Sugiyama et al. |
| 2017/0103830 | A1 | 4/2017 | Dettmer et al. |
| 2018/0096755 | A1 | 4/2018 | Tsujino et al. |

FOREIGN PATENT DOCUMENTS

| | | | |
|---|---|---|---|
| CN | 102231303 | B | 11/2012 |
| CN | 203931605 | U | 11/2014 |
| CN | 105741965 | A | 7/2016 |
| JP | 2000040423 | A | 2/2000 |
| JP | 2001093357 | A | 4/2001 |
| JP | 2012009321 | A | 1/2012 |
| JP | 2012238468 | A | 12/2012 |
| JP | 2013038082 | A | 2/2013 |
| JP | 2013258009 | A | 12/2013 |
| JP | 2014038802 | A | 2/2014 |
| JP | 2014078339 | A | 5/2014 |
| JP | 2014099404 | A | 5/2014 |
| JP | 2014142247 | A | 8/2014 |
| JP | 2014154490 | A | 8/2014 |
| JP | 2014157709 | A | 8/2014 |
| JP | 2015076138 | A | 4/2015 |
| JP | 2015146298 | A | 8/2015 |
| JP | 2015204195 | A | 11/2015 |
| JP | 2015230836 | A | 12/2015 |
| JP | 2016015255 | A | 1/2016 |
| JP | 2016027547 | A | 2/2016 |
| JP | 2016072007 | A | 5/2016 |
| JP | 2016072196 | A | 5/2016 |
| JP | 20161110960 | A | 6/2016 |
| JP | 2016213111 | A | 12/2016 |
| WO | 9641351 | A | 12/1996 |

OTHER PUBLICATIONS

OZ Optics "Metalized Fibers" (4 pages).
Corresponding U.S. Appl. No. 15/952,690, filed Apr. 13, 2018 (30 pages).
Corresponding U.S. Appl. No. 16/159,003, filed Oct. 12, 2018 (30 pages).
Corresponding U.S. Appl. No. 16/159,053, filed Oct. 12, 2018 (27 pages).

* cited by examiner

ELECTRICAL CABLE

BACKGROUND OF THE INVENTION

The subject matter herein relates generally to signal transmission electrical cables and shielding efficiency for signal conductors.

Shielded electrical cables are used in high-speed data transmission applications in which electromagnetic interference (EMI) and/or radio frequency interference (RFI) are concerns. Electrical signals routed through shielded cables radiate less EMI/RFI emissions to the external environment than electrical signals routed through non-shielded cables. In addition, the electrical signals being transmitted through the shielded cables are better protected against interference from environmental sources of EMI/RFI than signals through non-shielded cables.

Shielded electrical cables are typically provided with a cable shield formed by a tape wrapped around the conductor assembly. Signal conductors are typically arranged in pairs conveying differential signals. The signal conductors are surrounded by an insulator and the cable shield is wrapped around the insulator. However, where the cable shield overlaps itself, an air void is created. The air void affects the electrical performance of the conductors in the electrical cable by changing the dielectric constant of the electrical cable, leading to electrical signal timing skew.

A need remains for an electrical cable that improves signal performance.

BRIEF DESCRIPTION OF THE INVENTION

In one embodiment, an electrical cable is provided. The electrical cable includes a conductor assembly having a first conductor, a second conductor and an insulator surrounding the first conductor and the second conductor. The conductor assembly extends along a longitudinal axis for a length of the electrical cable. The insulator has an outer surface. The electrical cable includes a cable shield wrapped around the conductor assembly. The cable shield has an inner edge at a first end segment and an outer edge at a second end segment. The second end segment is wrapped over the inner edge and the first end segment to form a flap covering the inner edge and the first end segment. The second end segment forms a void at the inner edge. The electrical cable includes a void shield on the outer surface of the insulator between the insulator and the cable shield. The void shield extends between a first end and a second end. The void shield is conductive and forming an inner electrical shield. The void shield is aligned with the void and spanning entirely across the void. The cable shield is electrically connected to the void shield to form an outer electrical shield exterior of the void shield.

In another embodiment, an electrical cable is provided. The electrical cable includes a conductor assembly having a first conductor, a second conductor and an insulator surrounding the first conductor and the second conductor. The conductor assembly extends along a longitudinal axis for a length of the electrical cable. The insulator has an outer surface. The outer surface has a first segment and a second segment. The electrical cable includes a void shield on the outer surface of the insulator. The void shield is conductive and forms an inner electrical shield. The void shield includes a select metalization layer applied directly to and covering the first segment of the outer surface. The second segment is devoid of the select metalization layer. The electrical cable includes a cable shield wrapped around the conductor assembly. The cable shield has an inner edge at a first end segment and an outer edge at a second end segment. The second end segment is wrapped over the inner edge and the first end segment to form a flap covering the inner edge and the first end segment. The second end segment forms a void at the inner edge. The inner edge and the void are aligned with the void shield such that the void shield is interior of the void. the cable shield engages the void shield to form an outer electrical shield exterior of the void shield.

In another embodiment, an electrical cable is provided. The electrical cable includes a conductor assembly having a first conductor, a second conductor and an insulator surrounding the first conductor and the second conductor. The conductor assembly extends along a longitudinal axis for a length of the electrical cable. The insulator has an outer surface. The electrical cable includes a cable shield wrapped around the conductor assembly. The cable shield has an inner edge at a first end segment and an outer edge at a second end segment. The second end segment is wrapped over the inner edge and the first end segment to form a flap covering the inner edge and the first end segment. The second end segment form a void at the inner edge. The electrical cable includes a void shield on the outer surface of the insulator between the insulator and the cable shield. The void shield extends between a first end and a second end. The void shield includes conductive ink particles applied to the insulator cured to form the void shield. The void shield is conductive and defines an inner electrical shield of the electrical cable. The void shield is aligned with the void and spans entirely across the void. The cable shield is electrically connected to the void shield to form an outer electrical shield exterior of the void shield.

DETAILED DESCRIPTION OF THE INVENTION

Figure 1:
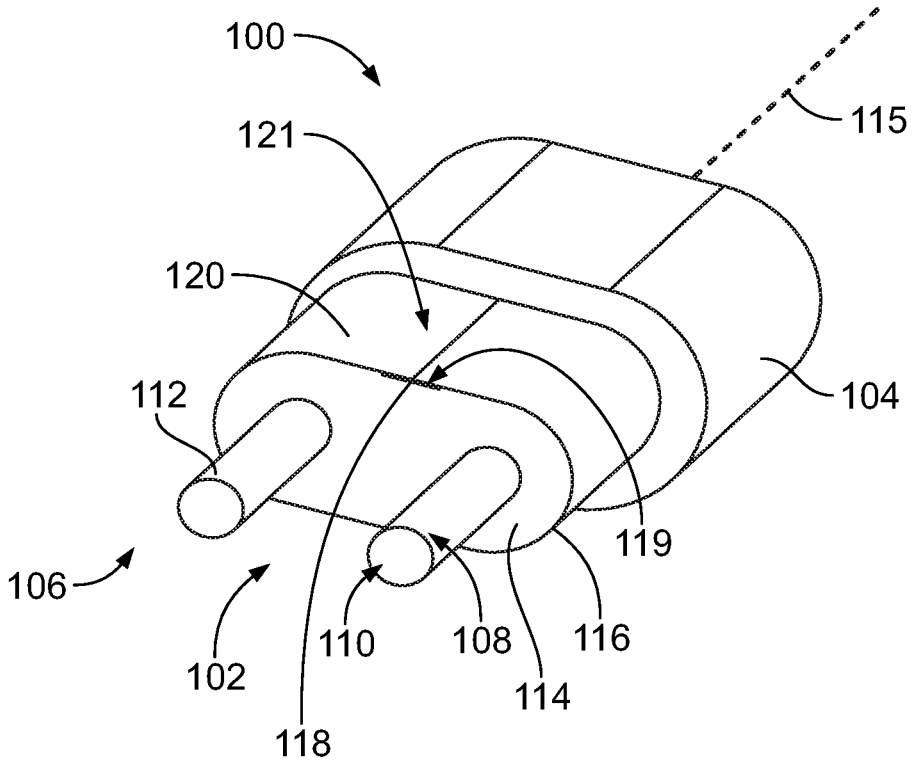
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. The electrical cable 100 has a shielding structure configured to control capacitance and inductance relative to the signal conductors to control signal skew in the electrical cable 100 for high speed applications.

The electrical cable 100 includes a conductor assembly 102. In various embodiments, the conductor assembly 102 is held within an outer jacket 104 of the electrical cable 100. The outer jacket 104 surrounds the conductor assembly 102 along a length of the conductor assembly 102. In FIG. 1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like. In alternative embodiments, the electrical cable 100 may be provided without the outer jacket 104.

The conductor assembly 102 includes inner conductors arranged in a pair 108 that are configured to convey data signals. In an exemplary embodiment, the pair 108 of conductors defines a differential pair conveying differential signals. The conductor assembly 102 includes a first conductor 110 and a second conductor 112. In an exemplary embodiment, the conductor assembly 102 is a twin-axial differential pair conductor assembly. The conductors 110, 112 extend the length of the electrical cable 100 along a longitudinal axis 115.

The conductor assembly 102 includes an insulator 114 surrounding the conductors 110, 112. In the illustrated embodiment, the insulator 114 is a monolithic, unitary insulator structure having an outer surface 116. In other various embodiments, the conductor assembly 102 may include first and second insulators surrounding the first and second conductors 110, 112, respectively, which are separate, discrete components sandwiched together in the cable core of the electrical cable 100 each having a corresponding outer surface. The first and second insulators together define the insulator 114 of the conductor assembly 102 (for example, the insulator 114 is a multi-piece insulator). In other various embodiments, the conductor assembly 102 may include first and second inner insulators surrounding the first and second conductors 110, 112, respectively, and an outer insulator surrounding both the first and second inner insulators. For example, the outer insulator may be extruded around the inner insulators.

The conductor assembly 102 includes a cable shield 120 surrounding the insulator 114. The cable shield 120 provides circumferential shielding around the pair 108 of conductors 110, 112 along the length of the electrical cable 100. The cable shield 120 forms an outer electrical shield 121 that provides electrical shielding for the conductors 110, 112. The cable shield 120 is wrapped around the insulator 114 to form a longitudinal seam that forms a void 140 (shown in FIG. 2). In various embodiments, the void 140 is a pocket of air defined interior of the cable shield 120. The cable shield 120 may be wrapped such that the void 140 is at the top. However, the cable shield 120 may be wrapped differently in alternative embodiments, such as with the void 140 at one side or the other.

The conductor assembly 102 includes a void shield 118 on the outer surface 116 of the insulator 114. The void shield 118 is conductive and defines an inner electrical shield 119 of the electrical cable 100. The void shield 118 provides shielding at the air void 140 created by the cable shield 120 along the length of the electrical cable 100. In an exemplary embodiment, the void shield 118 is applied directly to the outer surface 116. The void shield 118 engages the outer surface 116. The outer electrical shield 121 is exterior of the inner electrical shield 119. In various embodiments, the outer electrical shield 121 engages the void shield 118 to electrically connect the outer electrical shield 121 to the inner electrical shield 119.

As used herein, two components "engage" or are in "engagement" when there is direct physical contact between the two components. In various embodiments, the void shield 118 is a direct metallization shield structure selectively applied to the outer surface 116 of the insulator 114. In an exemplary embodiment, the void shield 118 is homogenous through a thickness of the void shield 118. For example, the void shield 118 may include conductive ink particles applied to the insulator 114, such as during an ink printing or other ink applying process. The conductive ink particles may be cured to form a homogenous coating layer. The void shield 118 may include metal particles sprayed on the insulator 114, such as through a thermal spraying process. The void shield 118 may be applied by other processes, such as a physical vapor deposition (PVD) process. The void shield 118 may be applied in multiple passes or layers to thicken the void shield 118. The void shield 118 may be plated to build up the void shield 118 on the insulator 114 in various embodiments.

The conductors 110, 112 extend longitudinally along the length of the cable 100. The conductors 110, 112 are formed of a conductive material, for example a metal material, such as copper, aluminum, silver, or the like. Each conductor 110, 112 may be a solid conductor or alternatively may be composed of a combination of multiple strands wound together. The conductors 110, 112 extend generally parallel to one another along the length of the electrical cable 100.

The insulator 114 surrounds and engages outer perimeters of the corresponding first and second conductors 110, 112. The insulator 114 is formed of a dielectric material, for example one or more plastic materials, such as polyethylene, polypropylene, polytetrafluoroethylene, or the like. The insulator 114 may be formed directly to the inner conductors 110, 112 by a molding process, such as extrusion, overmolding, injection molding, or the like. In an exemplary embodiment, the insulator 114 is coextruded with both conductors 110, 112. The insulator 114 extends between the conductors 110, 112 and the cable shield 120. The insulator 114 maintains the conductor to conductor spacing and the conductor to shield spacing. For example, the insulator 114 separates or spaces the conductors 110, 112 from one another and separates or spaces the conductors 110, 112 from the inner electrical shield 119 and/or the outer electrical shield 121. The insulator 114 maintains separation and positioning of the conductors 110, 112 along the length of the electrical cable 100. The size and/or shape of the conductors 110, 112, the size and/or shape of the insulator 114, and the relative positions of the conductors 110, 112 may be modified or selected in order to attain a particular impedance and/or capacitance for the electrical cable 100. For example, the conductors 110, 112 may be moved relatively closer or relatively further from each other to affect electrical characteristics of the electrical cable 100. The inner or outer electrical shields 119, 121 may be moved relatively closer or relatively further from the conductors 110, 112 to affect electrical characteristics of the electrical cable 100.

The cable shield 120 surrounds the void shield 118 and the insulator 114. The cable shield 120 is formed, at least in part, of a conductive material. In an exemplary embodiment, the cable shield 120 is a tape configured to be wrapped around the cable core. For example, the cable shield 120 may include a multi-layer tape having a conductive layer and an insulating layer, such as a backing layer. The conductive layer and the backing layer may be secured together by adhesive. Optionally, the cable shield 120 may include an adhesive layer, such as along the interior side to secure the cable shield 120 to the insulator 114 and/or itself. The conductive layer may be a conductive foil or another type of conductive layer. The insulating layer may be a polyethylene terephthalate (PET) film, or similar type of film. The conductive layer provides electrical shielding for the first and second conductors 110, 112 from external sources of EMI/RFI interference and/or to block cross-talk between other conductor assemblies 102 or electrical cables 100. In various embodiments, the cable shield 120 may be oriented with the conductive layer facing inward. Alternatively, the cable shield 120 may be oriented with the conductive layer facing outward. In an exemplary embodiment, the electrical cable 100 includes a wrap or another layer around the cable shield 120 that holds the cable shield 120 on the insulator 114. For example, the electrical cable 100 may include a helical wrap. The wrap may be a heat shrink wrap. The wrap is located inside the outer jacket 104.

The outer jacket 104 surrounds and may engage the outer perimeter of the cable shield 120 or the heat shrink wrap. In the illustrated embodiment, the outer jacket 104 engages the cable shield 120 along substantially the entire periphery of the cable shield 120. The outer jacket 104 is formed of at least one dielectric material, such as one or more plastics (for example, vinyl, polyvinyl chloride (PVC), acrylonitrile butadiene styrene (ABS), or the like). The outer jacket 104 is non-conductive, and is used to insulate the cable shield 120 from objects outside of the electrical cable 100. The outer jacket 104 also protects the cable shield 120 and the other internal components of the electrical cable 100 from mechanical forces, contaminants, and elements (such as fluctuating temperature and humidity). Optionally, the outer jacket 104 may be extruded or otherwise molded around the cable shield 120. Alternatively, the outer jacket 104 may be wrapped around the cable shield 120 or heat shrunk around the cable shield 120.

Figure 2:
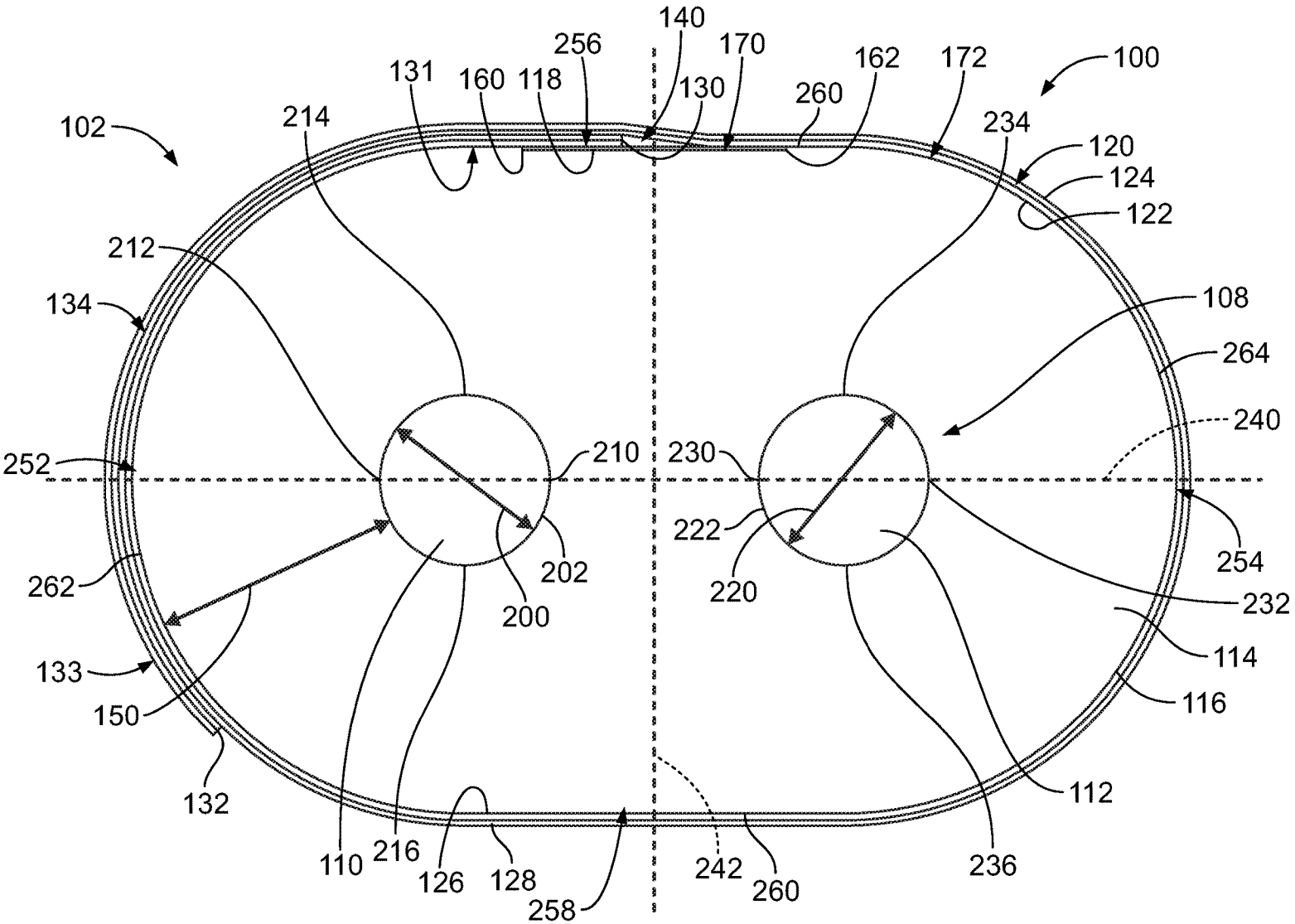
FIG. 2 is a cross-sectional view of the conductor assembly in accordance with an exemplary embodiment.

FIG. 2 is a cross-sectional view of the conductor assembly 102 in accordance with an exemplary embodiment. The void shield 118 provides shielding interior of the void 140. The void shield 118 spans across the void 140 and is electrically connected to the cable shield 120 at both sides of the void 140. In an exemplary embodiment, the void shield 118 is a direct metallization of a portion of the insulator 114 by applying the shield structure directly to the outer surface 116 of the insulator 114. The cable shield 120 is then wrapped around the void shield 118 and the insulator 114.

The cable shield 120 includes a conductive layer 122 and an insulating layer 124. In the illustrated embodiment, the conductive layer 122 is provided on an interior 126 of the cable shield 120 and the insulating layer 124 is provided on an exterior 128 of the cable shield 120 such that the conductive layer 122 may engage and be electrically connected to the void shield 118.

The cable shield 120 includes an inner edge 130 at a first end segment 131 of the cable shield 120 and an outer edge 132 at a second end segment 133 of the cable shield 120. When the cable shield 120 is wrapped around the cable core, the second end segment 133 overlaps the inner edge 130 and the first end segment 131 to form a flap 134 covering the inner edge 130 and the first end segment 131. The interior 126 of the second end segment 133 may be secured to the exterior 128 of the first end segment 131 along a seam, such as using adhesive or a heat shrink wrap around the entire cable shield 120. The interior 126 of portions of the cable shield 120 may be secured directly to the void shield 118. When the cable shield 120 is wrapped over itself to form the flap 134, the void 140 is created. The cable shield 120 may be wrapped such that the flap 134 is at the top and wrapping to the right side as in the illustrated embodiment. However, the cable shield 120 may be wrapped in other directions in alternative embodiments or at other positions in alternative embodiments.

The void 140 is created at the seam side of the electrical cable 100. In various embodiments, the void 140 is a pocket of air defined between the interior 126 of the second end segment 133 of the cable shield 120 and the void shield 118 on the insulator 114. In other various embodiments, the void 140 may be filled with another material, such as adhesive or other dielectric material. The second end segment 133 is elevated or lifted off of the insulator 114 and the void shield 118 to allow the flap 134 to clear the inner edge 130. Without the void shield 118 interior of, and thus between the void 140 and the conductors 110, 112, the volume of the air in the void 140 would affect the electrical characteristics of the conductors 110, 112 by changing the dielectric constant of the dielectric material between the conductive layer 122 of the cable shield 120 and the corresponding conductors 110, 112. Positioning the void shield 118 on the outer surface 116 of the insulator 114 interior of the void 140 reduces or eliminates the effect of the void 140 on the conductors 110, 112.

In conventional electrical cables without the void shield 118, the air in the void 140 leads to a skew imbalance for one of the conductors, such as the first conductor 110 or the second conductor 112. The void in conventional electrical cables changes the dielectric constant of the dielectric material around the first conductor 110 compared to the second conductor 112 leading to skew imbalance. For example, signals transmitted by the first conductor 110 may be transmitted faster than the signals transmitted by the second conductor 112, leading to skew in the differential pair in conventional electrical cables. However, the inclusion of the void shield 118 mitigates the effects of the air void 140 by positioning the shield structure of the electrical cable 100 interior of the air void 140. The distance between the conductors 110, 112 and the shield structure is maintained more uniformly around the electrical cable 100 by having the void shield 118 and the cable shield 120 cooperating to surround the insulator 114.

The void shield 118 is conductive and defines a shield structure for the first and second conductors 110, 112. The void shield 118 cooperates with the cable shield 120 to provide circumferential shielding around the pair 108 of conductors 110, 112, such as at a shield distance 150 between the conductors 110, 112 and the shield structure, which is defined by a thickness of the insulator 114. In an exemplary embodiment, the cable shield 120 directly engages the outer surface 116 and the void shield 118 is applied directly to the outer surface 116 at a select location (for example, aligned with the air void 140 and positioned interior of the air void 140) and thus the shield distance 150 is defined by the thickness of the insulator 114. The shield distance 150 may be variable around the conductor assembly 102, such as due to the shape of the outer surface 116 and the positioning of the conductors 110, 112 within the insulator 114. The void shield 118 and the cable shield 120 conform to the shape of the insulator 114 around the entire outer surface 116. The air void 140 is located outside of the shield structure, such as exterior of the void shield 118.

In an exemplary embodiment, the void shield 118 may include conductive particles applied to the insulator 114 as a coating on the outer surface 116. In various embodiments, the conductive particles are silver particles; however the conductive particles may be other metals or alloys in alternative embodiments. The conductive particles may be initially applied with non-conductive particles, such as binder material, some or all of which may be later removed, such as during a curing, drying or other process. For example, the conductive particles may be conductive ink particles applied by a printing, spraying, bathing or other application process.

For example, the void shield 118 may be a silver (or other metal, such as copper, aluminum and the like) ink coating applied to the insulator 114. The coated material may be processed, for example, cured or partially cured, to form the void shield 118. In various embodiments, the void shield 118 may be applied using a dipping bath, such as in a metal bath solution, and processed with IR heating in one or more passes. In various embodiments, the coating material may be dissolved metal material that is applied and cured to leave metal crystals behind as the conductive particles. In an exemplary embodiment, the void shield 118 is a homogenous coating layer. The void shield 118 may be applied in multiple passes or layers to thicken the void shield 118. The layers may be fully cured between applications in various embodiments. The layers may be partially cured between applications in other alternative embodiments.

In other various embodiments, the conductive particles may be deposited by other processes. For example, the void shield 118 may include metal particles sprayed on the insulator 114, such as through a thermal spraying process. The metal particles may be heated and/or melted and sprayed onto the outer surface 116 to form the void shield 118. When the metal particles are sprayed, the metal particles may be embedded into the outer surface 116 to secure the particles to the insulator 114. The metal particles may be heated to fuse the metal particles together on the outer surface 116 to form a continuous layer on the outer surface 116. Other processes may be used to apply the void shield 118 to the insulator 114, such as a physical vapor deposition (PVD) process. The void shield 118 may be plated to build up the void shield 118 on the insulator 114 in various embodiments.

The void shield 118 extends between a first end 160 and a second end 162. The void shield 118 is aligned with the void 140 and spans entirely across the void 140. The inner edge 130 of the cable shield 120 is aligned with the void shield 118 such that the first end 160 of the void shield 118 is at a first side of the inner edge 130 and the second end 162 of the void shield 118 is at a second side of the inner edge 130. Optionally, the first and second ends 160, 162 of the void shield 118 may be tapered (for example, thinner at the ends than in the middle of the void shield 118). The first end segment 131 of the cable shield 120 covers the first end 160 of the void shield 118 and the second end segment 133 of the cable shield 120 covers the second end 162 of the void shield 118. The void shield 118 has a width (when flat) between the first end 160 and the second end 162. The cable shield 120 has a width (when flat) between the inner edge 130 and the outer edge 132. The width of the void shield 118 is narrower than the width of the cable shield 120. Optionally, the width of the void shield 118 may be slightly wider than the air gap 140 to ensure that the void shield 118 spans entirely across the air gap 140.

In an exemplary embodiment, the outer surface 116 of the insulator 114 has a first segment 170 and a second segment 172. The void shield 118 covers the first segment 170 of the outer surface 116 and the cable shield 120 covers the second segment 172 of the outer surface 116. For example, the void shield 118 directly engages the first segment 170 of the outer surface 116 and the cable shield 120 directly engages the second segment 172 of the outer surface 116. The second segment 172 of the outer surface 116 is devoid of the void shield 118 (for example, the void shield 118 is only on the first segment 170). The void shield 118 is positioned between and separates the cable shield 120 from the first segment 170 of the outer surface 116. In the illustrated embodiment, the first segment 170 is defined along the top of the insulator 114; however, the first segment 170 may be located along the first curved end or the second curved end or may be located along the bottom in alternative embodiments. In the illustrated embodiment, the first segment 170 is a flat portion of the insulator 114. The void shield 118 is provided on the flat portion and is planar along the flat portion. However, the void shield 118 may additionally or alternatively extend along one of the curved ends. The cable shield 120 surrounds the entire insulator 114, including the first segment 170 and the second segment 172, with the void shield 118 located between the first segment 170 and the cable shield 120. In an exemplary embodiment, the first segment 170 is shorter than the second segment 172. For example, the second segment 172 may extend along a majority of the outer surface 116. In the illustrated embodiment, the first segment 170 is centered along the top of the insulator 114 being centered between the first and second conductors 110, 112. The void shield 118 is centered between the first and second conductors 110, 112.

In an exemplary embodiment, the first conductor 110 has a first conductor outer surface 202 having a circular cross-section of a first diameter 200. The first conductor 110 has an inner end 210 facing the second conductor 112 and an outer end 212 opposite the inner end 210. The first conductor 110 has a first side 214 (for example, a top side) and a second side 216 (for example, a bottom side) opposite the first side 214. The first and second sides 214, 216 are equidistant from the inner and outer ends 210, 212.

In an exemplary embodiment, the second conductor 112 has a second conductor outer surface 222 having a circular cross-section of a second diameter 220. The second conductor 112 has an inner end 230 facing the first conductor 110 and an outer end 232 opposite the inner end 230. The second conductor 112 has a first side 234 (for example, a top side) and a second side 236 (for example, a bottom side) opposite the first side 234. The first and second sides 234, 236 are equidistant from the inner and outer ends 230, 232.

The conductor assembly 102 extends along a lateral axis 240 bisecting the first and second conductors 110, 112, such as through the inner ends 210, 230 and the outer ends 212, 232. Optionally, the lateral axis 240 may be centered in the insulator 114. The conductor assembly 102 extends along a transverse axis 242 centered between the first and second conductors 110, 112, such as centered between the inner ends 210, 230 of the first and second conductors 110, 112. Optionally, the transverse axis 242 may be centered in the insulator 114. In an exemplary embodiment, the transverse axis 242 is located at the magnetic center of the cable core between the first and second conductors 110, 112. In an exemplary embodiment, the longitudinal axis 115 (shown in FIG. 1), the lateral axis 240 and the transverse axis 242 are mutually perpendicular axes. In an exemplary embodiment, the insulator 114 is symmetrical about the lateral axis 240 and the transverse axis 242. In an exemplary embodiment, the void shield 118 and the air void 140 are aligned with the transverse axis 242, such as centered with the transverse axis 242.

In an exemplary embodiment, the outer surface 116 has a generally elliptical or oval shape defined by a first end 252, a second end 254 opposite the first end 252, a first side 256 (for example, a top side) and a second side 258 (for example, a bottom side) opposite the first side 256. The first and second sides 256, 258 may have flat sections 260 and may have curved sections 262, such as at the transitions with the first and second ends 252, 254. In the illustrated embodiment, the void shield 118 and the air void 140 are provided on the flat section 260; however, the void shield 118 may be provided at alternative locations depending on the location of the air void 140. The first and second ends 252, 254 have curved sections 264 that transition between the first and second sides 256, 258. The material of the insulator 114 between the conductors 110, 112 and the outer surface 116 has a thickness. Optionally, the thickness may be uniform. Alternatively, the thickness may vary, such as being narrower at the first and second sides 256, 258 and being widest at the centroids of the first and second ends 252, 254.

The insulator thickness defines the shield distance 150 between the shield structure and the corresponding conductors 110, 112. The shield distance 150 between the void shield 118 and the conductors 110, 112 affects the electrical characteristics of the signals transmitted by the conductors 110, 112. For example, the shield distance 150 may affect the delay or skew of the signal, the insertion loss of the signal, the return loss of the signal, and the like. The dielectric material between the void shield 118 and the corresponding conductors 110, 112 affects the electrical characteristics of the signals transmitted by the conductors 110, 112. The effects of the air void 140 are significantly reduced if not entirely eliminated by locating the void shield 118 interior of the air void 140.

Figure 3:
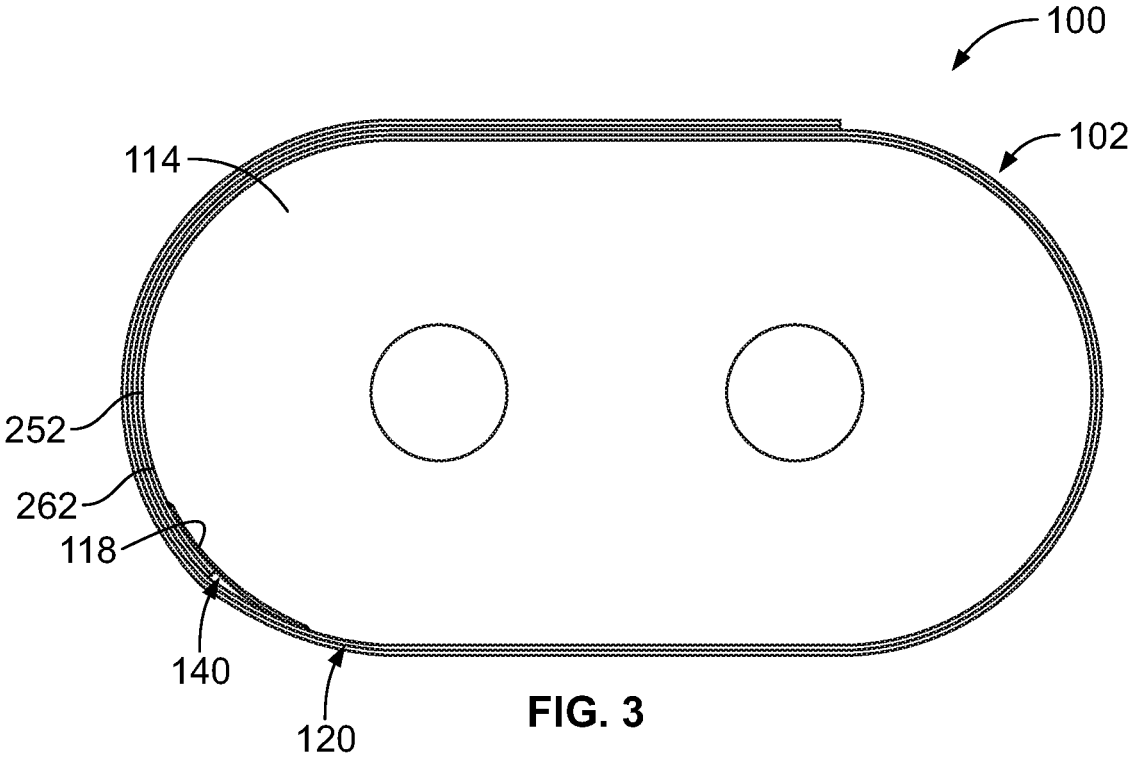
FIG. 3 is a cross-sectional view of the conductor assembly of the electrical cable in accordance with an exemplary embodiment.

FIG. 3 is a cross-sectional view of the conductor assembly 102 of the electrical cable 100 in accordance with an exemplary embodiment. FIG. 3 shows the air void 140 and the void shield 118 at a different location. In the illustrated embodiment, the air void 140 and the void shield 118 are located along the curved section 262 at the first end 252 of the insulator 114. The void shield 118 is curved in the illustrated embodiment. The cable shield 120 surrounds the insulator 114 and the void shield 118.

Figure 4:
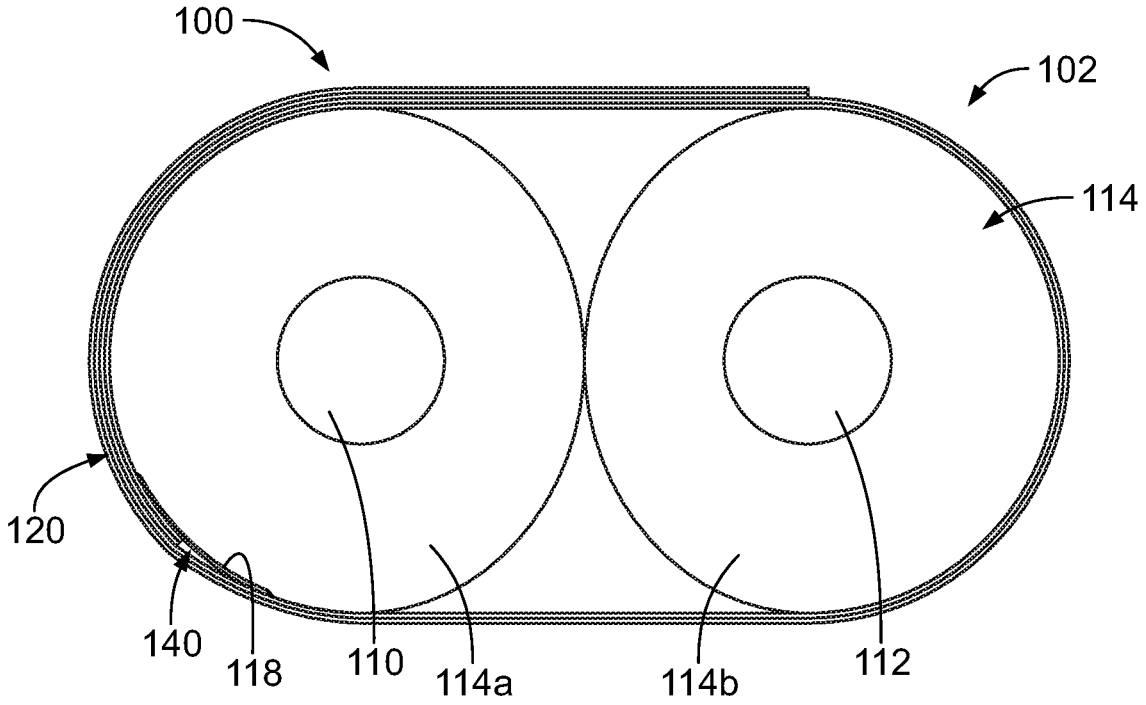
FIG. 4 is a cross-sectional view of the conductor assembly of the electrical cable in accordance with an exemplary embodiment.

FIG. 4 is a cross-sectional view of the conductor assembly 102 of the electrical cable 100 in accordance with an exemplary embodiment. FIG. 4 shows the insulator 114 of the conductor assembly as two separate insulator members surrounding the conductors 110, 112. The insulator 114 includes a first insulator member 114*a* surrounding the first conductor 110 and a second insulator member 114*b* surrounding the conductor 112. FIG. 4 shows the air void 140 and the void shield 118 at the first insulator member 114*a*. In the illustrated embodiment, the void shield 118 is located between the air void 140 and the first insulator member 114*a*. The cable shield 120 surrounds both insulator members 114*a*, 114*b* and the void shield 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical cable comprising:

a conductor assembly having a first conductor, a second conductor and an insulator surrounding the first conductor and the second conductor, the conductor assembly extending along a longitudinal axis for a length of the electrical cable, the insulator having an outer surface;

a cable shield wrapped around the conductor assembly, the cable shield having an inner edge at a first end segment and an outer edge at a second end segment, the second end segment wrapped over the inner edge and the first end segment to form a flap covering the inner edge and the first end segment, the second end segment forming a void at the inner edge; and a void shield on the outer surface of the insulator between the insulator and the cable shield, the void shield extending between a first end and a second end, the void shield extending only partially around the insulator such that a portion of the insulator is uncovered by the void shield, the void shield being conductive and forming an inner electrical shield, the void shield being aligned with the void and spanning entirely across the void, the cable shield being electrically connected to the void shield to form an outer electrical shield exterior of the void shield;

wherein the first end segment of the cable shield covers the first end of the void shield and the second end segment of the cable shield covers the second end of the void shield.

2. The electrical cable of claim 1, wherein the void shield is narrower than the cable shield.

3. The electrical cable of claim 1, wherein the first and second ends of the void shield are tapered.

4. The electrical cable of claim 1, wherein the inner edge of the cable shield is aligned with the void shield such that the first end of the void shield is at a first side of the inner edge and the second end of the void shield is at a second side of the inner edge.

5. The electrical cable of claim 1, wherein the outer surface has a first segment and a second segment, the void shield covering the first segment of the outer surface, the second segment of the outer surface being devoid of the void shield.

6. The electrical cable of claim 5, wherein the cable shield directly engages the second segment of the outer surface of the insulator.

7. The electrical cable of claim 6, wherein the void shield is positioned between and separates the cable shield from the first segment of the outer surface of the insulator.

8. The electrical cable of claim 1, wherein the void shield is planar.

9. The electrical cable of claim 1, wherein the insulator includes a flat portion between curved ends of the insulator, the first and second ends of the void shield provided on the flat portion, the cable shield covering the flat portion and the curved ends of the insulator.

10. The electrical cable of claim 1, wherein the void shield is centered between the first and second conductors.

11. The electrical cable of claim 1, wherein the void shield extends less than half way around the insulator of the electrical cable.

12. The electrical cable of claim 1, wherein the cable shield includes a conductive layer and a dielectric layer, the conductive layer being interior of the dielectric layer to directly electrically connect to the void shield.

13. The electrical cable of claim 1, wherein the conductor assembly extends along a lateral axis bisecting the first and second conductors and the conductor assembly extends along a transverse axis centered between the first and second conductors, the longitudinal axis, the lateral axis and the transverse axis being mutually perpendicular axes, the void shield and the void being aligned with the transverse axis.

14. The electrical cable of claim 1, wherein the insulator includes a first insulator surrounding the first conductor and a second insulator surrounding the second conductor separate and discrete from the first insulator.

15. The electrical cable of claim 1, wherein the void shield includes conductive ink particles applied to the insulator cured to form the void shield.

16. The electrical cable of claim 1, wherein the void shield includes metal particles sprayed on the insulator.

17. An electrical cable comprising:

a conductor assembly having a first conductor, a second conductor and an insulator surrounding the first conductor and the second conductor, the conductor assembly extending along a longitudinal axis for a length of the electrical cable, the insulator having an outer surface, the outer surface having a first segment and a second segment;

a void shield on the outer surface of the insulator, the void shield extending only partially around the insulator such that a majority of the insulator is uncovered by the void shield, the void shield being conductive and forming an inner electrical shield, the void shield including a select metalization layer applied directly to and covering the first segment of the outer surface, the second segment being devoid of the select metalization layer; and a cable shield wrapped around the conductor assembly, the cable shield having an inner edge at a first end segment and an outer edge at a second end segment, the second end segment wrapped over the inner edge and the first end segment to form a flap covering the inner edge and the first end segment, the second end segment forming a void at the inner edge, the inner edge and the void being aligned with the void shield such that the void shield is interior of the void, the cable shield engaging the void shield to form an outer electrical shield exterior of the void shield.

18. The electrical cable of claim 17, wherein the first end segment of the cable shield covers the first end of the void shield and the second end segment of the cable shield covers the second end of the void shield.

19. The electrical cable of claim 17, wherein the cable shield directly engages the second segment of the outer surface of the insulator, the void shield being positioned between and separating the cable shield from the first segment of the outer surface of the insulator.

20. An electrical cable comprising:

a conductor assembly having a first conductor, a second conductor and an insulator surrounding the first conductor and the second conductor, the conductor assembly extending along a longitudinal axis for a length of the electrical cable, the insulator having an outer surface;

a cable shield wrapped around the conductor assembly, the cable shield having an inner edge at a first end segment and an outer edge at a second end segment, the second end segment wrapped over the inner edge and the first end segment to form a flap covering the inner edge and the first end segment, the second end segment forming a void at the inner edge; and a void shield on the outer surface of the insulator between the insulator and the cable shield, the void shield extending between a first end and a second end, the void shield includes conductive ink particles applied to the insulator cured to form the void shield, the void shield being conductive defining an inner electrical shield of the electrical cable, the void shield being aligned with the void and spanning entirely across the void, the cable shield being electrically connected to the void shield to form an outer electrical shield exterior of the void shield.

* * * * *